US006695174B2

(12) United States Patent
Sørensen et al.

(10) Patent No.: US 6,695,174 B2
(45) Date of Patent: Feb. 24, 2004

(54) SOAP DISPENSER

(75) Inventors: Henrik Bønnelycke Sørensen, Åbyhøj (DK); Søren Lolk, Hørning (DK)

(73) Assignee: Scandinavian Amenities A/S, Hvidovre (DK)

( * ) Notice: Subject to any disclaimer, the term of this patent is extended or adjusted under 35 U.S.C. 154(b) by 0 days.

(21) Appl. No.: 10/358,363

(22) Filed: Feb. 5, 2003

(65) Prior Publication Data

US 2003/0141318 A1 Jul. 31, 2003

Related U.S. Application Data

(63) Continuation of application No. PCT/DK01/00528, filed on Aug. 8, 2001.

(30) Foreign Application Priority Data

Aug. 8, 2000 (DK) ..... 2000 01189

(51) Int. Cl.[7] ..... B65D 37/00
(52) U.S. Cl. ..... 222/214; 222/183; 222/494
(58) Field of Search ..... 222/213, 214, 222/183, 494, 209, 181.3

(56) References Cited

U.S. PATENT DOCUMENTS

| | | | | |
|---|---|---|---|---|
| 1,760,945 A | | 6/1930 | Grigsby | |
| 2,643,029 A | | 6/1953 | Chapman et al. | 222/103 |
| 3,926,347 A | | 12/1975 | Low et al. | 222/185 |
| 4,324,348 A | | 4/1982 | Johnson et al. | 222/181 |
| 4,634,022 A | | 1/1987 | O'Halloran et al. | 222/95 |
| 4,932,562 A | | 6/1990 | Christine | 222/96 |
| 5,037,005 A | * | 8/1991 | Appleby et al. | 222/494 |
| 5,067,635 A | | 11/1991 | Thomsen | 222/103 |
| 5,105,984 A | | 4/1992 | Kazimir | 222/103 |
| 5,431,304 A | | 7/1995 | Gentile | 222/103 |
| 5,806,717 A | | 9/1998 | De Rosenzeig-Page et al. | 222/105 |
| 5,897,030 A | | 4/1999 | Stangle | 222/103 |
| 6,152,330 A | | 11/2000 | Polan | 222/156 |

FOREIGN PATENT DOCUMENTS

DK 155212 B 3/1989

* cited by examiner

*Primary Examiner*—Philippe Derakshani
(74) *Attorney, Agent, or Firm*—Winston & Strawn LLP

(57) ABSTRACT

A dispenser for a liquid or viscous soap. The dispenser includes a disposable soap container having a discharge end and a feed pump for pumping a dose of soap out of the discharge end, a housing for receiving the soap container via a front aperture in the housing, and a cover for closing the front aperture of the housing. This cover is pivotally mounted about a horizontal swing axis extending across an upper edge in the front aperture of the housing. Furthermore, the cover is arranged to be able to swing between a first swing position in which the front aperture is clear, a second swing position in which the front aperture is covered and the cover is in contact with the pump, and at least a third swing position in which the cover has activated the feed pump. The dispenser has a simple, inexpensive design with no wearing parts that require maintenance.

19 Claims, 3 Drawing Sheets

SOAP DISPENSER

CROSS-REFERENCE TO RELATED APPLICATIONS

This application is a continuation of International application PCT/DK01/00528 filed Aug. 8, 2001, the entire content of which is expressly incorporated herein by reference thereto.

BACKGROUND

The invention relates to a dispenser for liquid or viscous soap and of the kind that comprises a disposable soap container having a discharge end mainly at the bottom in the state of use and a feed pump for pumping a dose of soap out of the discharge end, a housing for receiving the soap container via a front aperture in the housing, and a cover for closing the front aperture of the housing.

A very widespread soap dispenser is arranged with a reservoir for refilling with soap from a larger soap container. In publicly accessible bathrooms and/or lavatories in, e.g., hotels or restaurants, such a dispenser is usually mounted on a wall. Therefore, the dispenser is not very accessible to the staff who are responsible for checking the soap content of the reservoir and refilling it with new soap when necessary. Therefore, attending to these known soap dispensers is rather difficult and time-consuming for an often busy staff. Furthermore, refilling of the reservoir easily results in soap running down the sides of the dispenser, requiring that these sides must then laboriously be washed off so as not be left in an unacceptable greasy and unhygienic state.

Another problem of these known soap dispensers is that their design is rather complex and therefore expensive, and that they comprise a large number of components which are subjected to wear and tear which inevitably will require regular maintenance.

When the soap dispenser is of the kind that has a fixed, built-in valve, this valve will eventually furthermore not be able to function effectively as it gradually blocks up with soap and/or becomes leaky so that the soap will leak out of the soap reservoir.

With a view to solve the above problems, dispensers have been developed with replaceable disposable containers which are provided with each their valve. Such a dispenser is known from, e.g., U.S. Pat. No. 5,806,717. In this case, the valve of the dispenser is now replaced at the same time as the disposable container. Thereby, the problem with the gradual wear of the valve is effectively solved. The soap supply of the dispenser can furthermore be restored quickly and easily even by untrained staff and without subsequently having to spend time and energy on cleaning the dispenser.

Common to the two types of dispensers is that they have a relatively small, compact feed pump which is activated by pressing on, e.g. with a finger, a correspondingly small activation location which however is difficult to see due to its modest size and especially to persons having impaired sight. Furthermore, the activation requires a concentrated, relatively great application of force which many have to exert a strong effort to do. This is a serious problem especially to persons having weak fingers.

Accordingly, there is a need for improved soap dispensers that do not possess the disadvantages of the prior art. The present invention now provides such improved dispensers.

SUMMARY OF THE INVENTION

The present invention provides a dispenser which has a simple, inexpensive design and no components that gradually would become ineffective and unhygienic through wear. In addition, the soap content of the dispenser can be restored easily and quickly without in this connection having to clean the dispenser. Furthermore, refilling of the dispenser is easily activated even by persons having weak hands and fingers and/or impaired sight.

The novel and unique features of the invention, whereby this is achieved, are obtained by providing a cover that is pivotally mounted about a mainly horizontal swing axis extending across an upper edge in the front aperture of the housing, when viewed in the mounted state of the housing. This cover is designed to swing between a first swing position, in which the front aperture is clear, a second swing position, in which the front aperture is covered and the cover is in contact with the pump, and a third swing position, in which the cover has activated the feed pump under the influence of an external force.

By means of this design, not only does the cover close the front aperture in its second swing position, which is the rest position of the dispenser, to impart to the dispenser an aesthetically beautiful and attractive design, but it also advantageously functions as an activator to the soap pump of the dispenser. The large, outwardly facing face of the cover can be pressed by means of, e.g., a hand, arm or elbow when the pump is to be activated. Therefore, the activation of the dispenser can easily be done by joints that are much stronger than a finger. The dispenser according to the invention is therefore easy and convenient to operate to all and especially persons having weak fingers and/or impaired sight.

The dispenser according to the invention is based on the use of disposable containers, i.e., containers that are discarded when they are empty and that are replaced each time by a new, full container of liquid soap. These disposable containers are each provided with a valve, so that the dispenser will always be able to function effectively and hygienically as far as this component is concerned. Furthermore, the soap supply can be restored quickly and easily without having to spend time and energy on subsequent cleaning of the dispenser.

When it is the soap container itself that functions as feed pump, an especially simple solution is obtained. This is due to the fact that the cover by e.g. manually being pressed from its second to its third swing position, easily can be compressed a little by a modest application of force so that a dose of soap is displaced from the container to run out of the discharge end. Furthermore, the simultaneous disappearance of a separate feed pump advantageously results in fewer expensive components being used to construct the dispenser.

By designing the soap container with an outwardly curved area extending at least partly out of the front aperture of the housing in the mounted position of the container and letting the cover be in contact with exactly this area in its second swing position, it is obtained that the compression of the soap container is localized to this outwardly curved area. Thereby, the advantage is obtained in that the soap can be dosed with great accuracy. It is to be noted that the outwardly curved area can be extending across the entire exterior of the soap container or a considerable part of this exterior in an advantageous embodiment.

When the cover in a vertical cross section, i.e. in a cross section perpendicular to the swing axis of the cover, is bending in the opposite direction of the outwardly curved area on the front of the soap container, seen in the second swing position of the cover, the cover will be pressing against the outwardly curved area of the soap container with a relatively small area during the activation of the pump.

This means that only a modest, manual application of force is required to dose a portion of soap.

By furthermore letting at least a part of the cover extend mainly linearly, seen in horizontal cross section, the additional advantage is obtained in that the cover will present an even and expedient contact face to the manual action which is required to activate the dispenser. For this purpose, a person can therefore conveniently use e.g. a hand, arm or elbow as desired.

When the soap container is made of an elastic plastic having memory of the original shape of the container, the container will advantageously return to its original shape after each dosing operation.

When the soap container is designed as soap pump, a nonreturn valve for opening on both positive pressure and negative pressure in the soap container can advantageously be fitted in the discharge end of the soap pump. The nonreturn valve ensures against soap unintentionally running out of the soap container in the rest position of the dispenser.

If the cover now is guided from its second to its third swing position, the pressure in the soap container will increase, the result of which is that the nonreturn valve is opened for dosing of a dose of soap. When the load is removed from the cover, the container will straighten again due to the inherent memory of the elastic plastic. In the soap container, a negative pressure is generated so that air is let into the container to fill the just generated negative pressure. The soap container is now ready for the next dosing operation.

When each disposable soap container has been provided with separate nonreturn valve in advance, the considerable advantage is obtained in that the dispenser is always functioning with a hygienic and effectively functioning nonreturn valve as this is replaced automatically at the same time as an empty soap container is replaced by a full one.

By providing the soap container with a mainly rectangular shape, as seen in a horizontal cross section, it is advantageously obtained that the soap container with a limited spatial requirement can contain a relatively large amount of soap. Another advantage is that the deformation of the soap container upon dispensing of a dose of soap is, to a considerable extent, concentrated to the outwardly curved area of the soap container whereby accurate dosing of the soap is ensured.

When the housing inside has a guide for keeping the soap container in place, it is ensured that the soap container is kept effectively in place in the housing without actual support by the cover which therefore advantageously is allowed to freely be able to function as activator to the pump.

At each of two opposite sides, the dispenser housing can be provided with a projecting flange extending mainly perpendicular to the swing axis of the cover in the longitudinal direction and serving to strengthen the housing in the area around the front aperture of the housing.

To give the dispenser a beautiful and harmonic overall impression, the cover can furthermore have a breadth corresponding to the distance between the outer edges of these flanges so that the cover will cover the entire front of the housing.

BRIEF DESCRIPTION OF THE DRAWINGS

The invention will be explained in greater detail below, describing only an exemplary embodiment with reference to the drawing, in which.

DETAILED DESCRIPTION OF PREFERRED EMBODIMENTS

Figure 1:
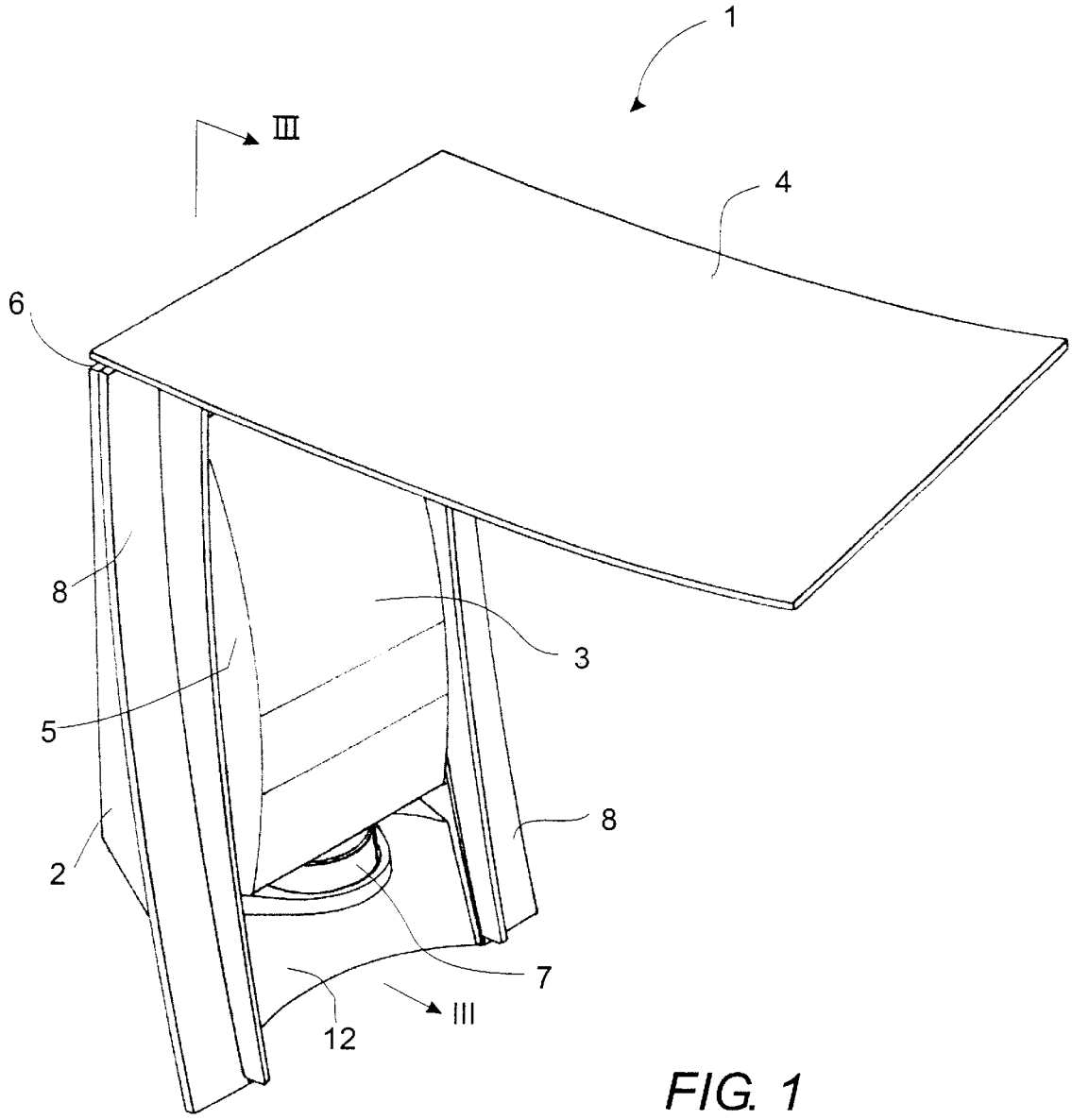
FIG. 1 is an oblique front perspective view of a dispenser according to the invention with a cover in a first swing position.

FIG. 1 shows a dispenser according to the invention generally designated by the reference numeral 1. The dispenser is especially intended for being mounted on a wall in a bathroom and/or lavatory in e.g. a hotel, a restaurant or similar establishment. The main components of the dispenser are a housing 2, a soap container 3, and a cover 4.

In the following, it is assumed that the soap container is a disposable container, that is a container which is discarded when it is empty and replaced by a new, full container. In FIG. 1, the soap container is shown in its position of use in the housing. The housing has a front aperture 5 for allowing the soap container to be guided in and out of the housing.

The cover 4 is pivotally mounted about a swing axis 6 which is mainly horizontal in the mounted position of the dispenser. In FIG. 1, the cover is in a first swing position in which the front aperture of the housing is clear so that the soap container can be guided in or out of the housing.

Inside, the housing 2 is provided with a guide 7 for ensuring that the soap container is kept effectively in place without support from the cover 4 which therefore can function as activator to the soap pump of the dispenser as will be described in detail below. Under the guide 7, the housing has a curved back wall 12 extending in a direction towards the front aperture of the housing.

At each of two opposite sides, the housing is provided with a projecting flange 8 extending perpendicular to the swing axis 6 of the cover in the longitudinal direction. The flanges strengthen and stiffen the housing in the area around its front aperture 5. The cover 4 furthermore has a breadth corresponding to the distance between the outer edges of the two flanges. Thereby, the dispenser will, in its rest position, appear with a beautiful and harmonic design characterized by the simple line of the cover.

Figure 2:
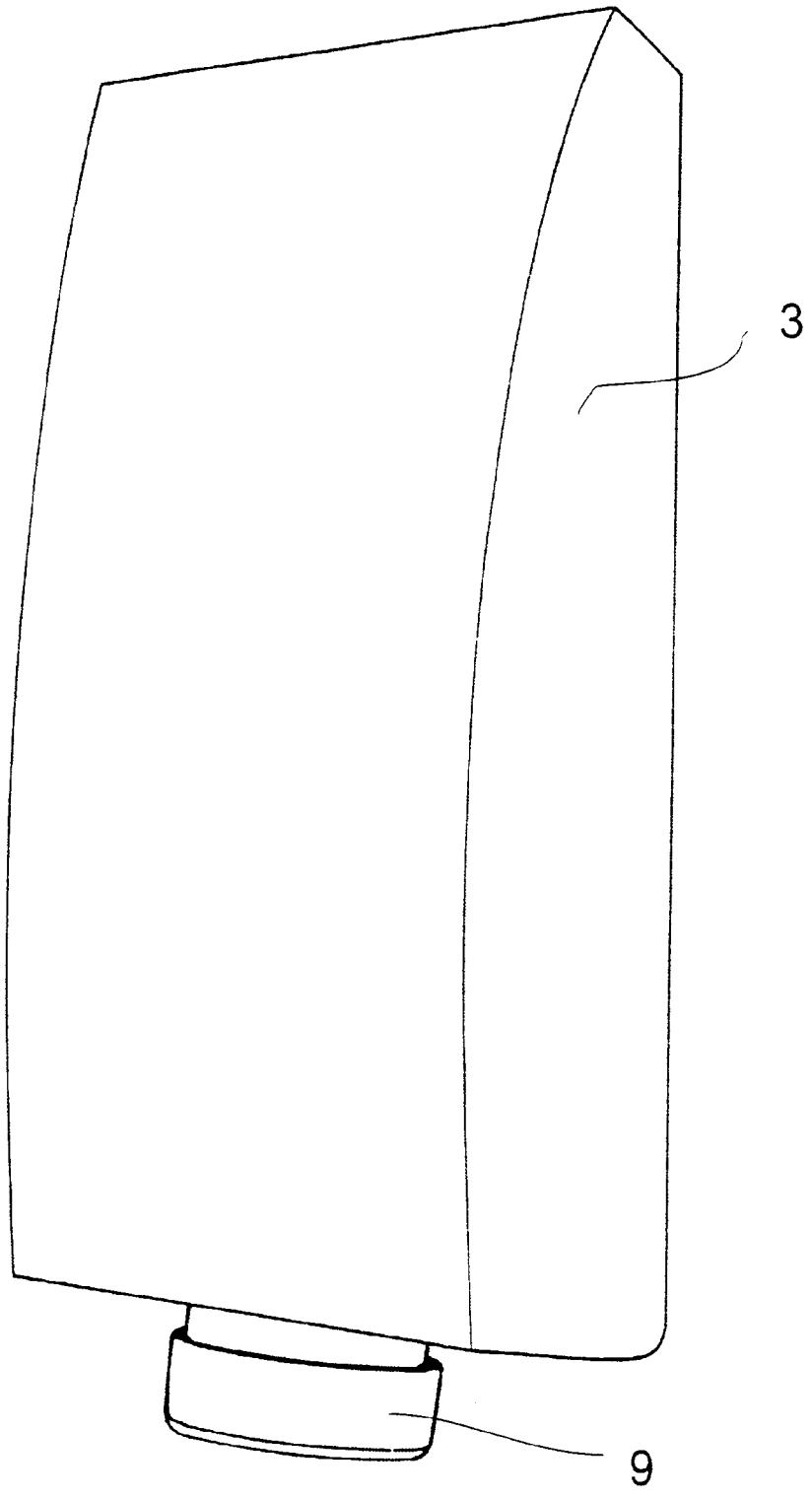
FIG. 2 is on a larger scale an oblique front perspective view of a soap container for the dispenser in FIG. 1.

In FIG. 2, the disposable soap container 3 is shown obliquely from the front in perspective, closed at the bottom with a special cap 9 which contributes to retaining the soap container in the guide 7. The soap container is made of an elastic plastic having memory. That is the sides of the soap container will automatically try to return to their original shape when they have been mechanically deformed and then relieved.

Figure 3:
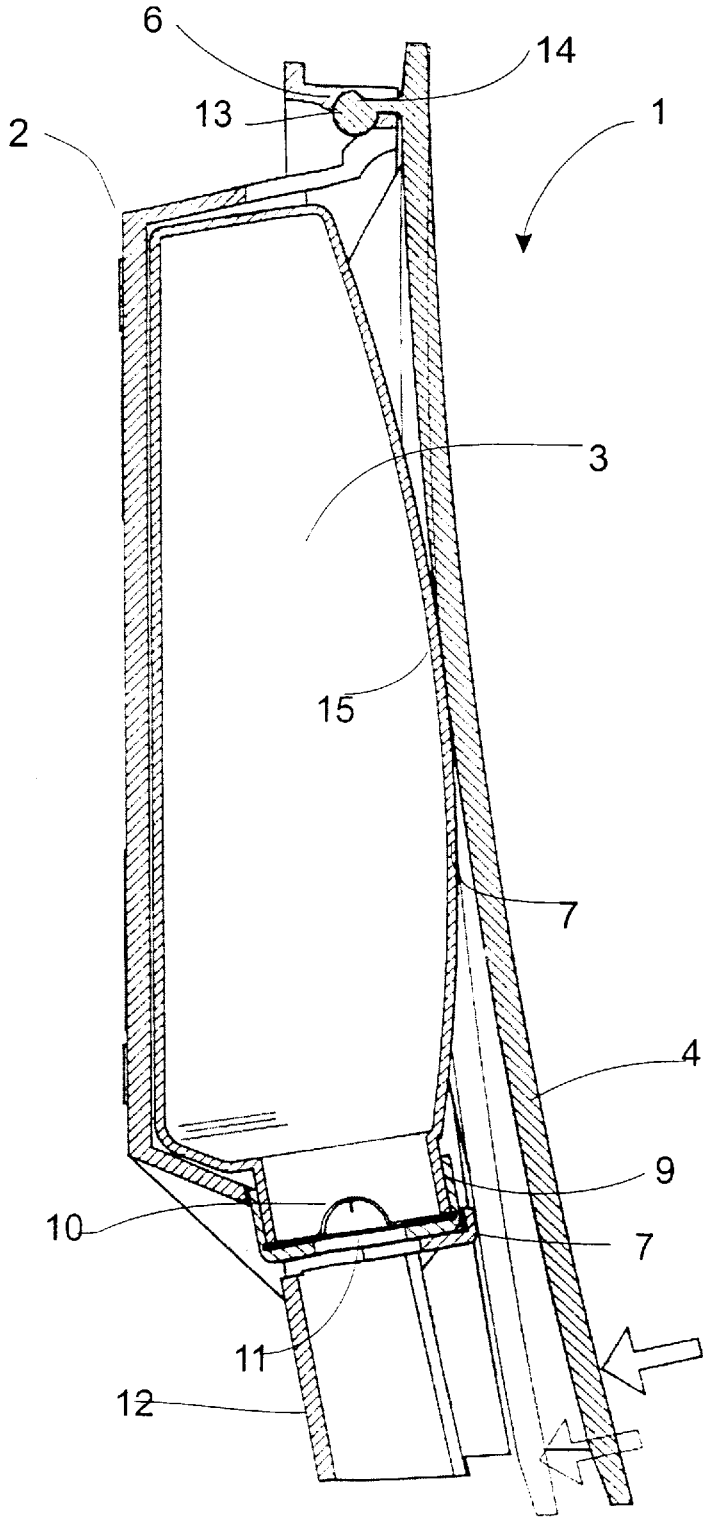
FIG. 3 is a sectional view taken along the line III—III of FIG. 1 but with the cover in a second swing position.

FIG. 3 shows a horizontal cross section through the dispenser 1. It can be seen that the soap container is fixed in its guide 7, and that the cover 4 is in its second swing position in which it covers the front aperture 5 and is in contact with the soap container 3.

There is a nonreturn valve 10 in the cap 9 of the soap container, and the cap has a discharge end 11 under this valve. During storage and transportation, this discharge end is preferably closed with a sticker (not shown) which is torn off when the soap container is to be used.

The housing has a bearing 13 for receiving a journal 14 on the cover 4. The bearing 13 and the journal 14 together form a hinge which defines the swing axis 6 of the cover. However, the bearing 13 and the journal 14 are detachably joined in such a way that the two parts easily can be separated when the cover is swung up past its first swing position. When the cover is to be cleaned, it can therefore separately be taken off the dispenser without this dispenser having to be taken down from the wall at the same time.

In the direction parallel to the swing axis 6, the cover has an expedient, linear extent that grant the cover a beautiful and simple line.

On the exterior of the soap container 3, an outwardly curved area 15 is designed which is extending across the entire exterior of the soap container in the case shown. A part of this outwardly curved area is extending a short distance from the front aperture 5 of the housing. Furthermore, the cover 4 is bending in the opposite direction of the outwardly curved area of the soap container.

A person wanting a dose of soap, e.g. for washing his hands, can conveniently press the cover 4 in the direction indicated by the arrows. Thereby, the cover is guided from its second swing position to a third one at the same time as the outwardly curved area of the soap container is elastically compressed a little. During this time, a positive pressure is generated in the soap container. Under the influence of this positive pressure, the nonreturn valve 10 opens and thereby allows a dose of soap to run out via the discharge end 11 in the cap 9. During this time, only a modest manual application of force by the user is required to provide this user with a desired dose of soap due to the curved shape of the cover and the outwardly curved pressure area of the soap container 3.

When the cover is relieved again, a negative pressure will be generated in the soap container 3, that will make the nonreturn valve 10 open in the opposite direction. Thereby, air is let into the container 3 to compensate the just generated negative pressure. Due to the elasticity and memory of the container material, the container will therefore straighten and assume its original shape. Then, the dispenser is immediately ready for a new dosing operation.

As can be seen, the cover functions as an expedient activator to the soap pump of the dispenser, and the cover will conceal the rest of the dispenser in its second swing position. To a user, it will therefore be self-evident that it is the cover itself which is to be pressed when a dose of soap is to be dosed.

By means of this design, the user does not have to, as in conventional dispensers, look for small activation locations which often will be difficult to see especially to persons having impaired sight. Furthermore, it is not necessary, as in conventional dispensers, to use a finger for activating the soap pump. The large and even extent of the cover presents a convenient and attractive contact face to the person who is using the dispenser and who for this purpose also can use stronger joints, such as e.g. a hand, arm or elbow.

Thus, the user can grip around both the fixed back wall 12 on the housing 2 and the lower edge area of the pivotal cover 4 with his hand and by means of this solid grip easily press the cover in towards the housing. When doing this, the cover will press on the outwardly curved area on the soap container which, as soap pump, thereby doses a dose of soap down into e.g. the user's hand.

The relation between the distance from the swing axis of the cover to its edge and pressure area respectively advantageously creates a ratio of transmission for substantially reducing the amount of force required to be able to operate the dispenser.

As a fixed soap reservoir which periodically must be refilled from another soap container is not used in the dispenser described above according to the invention but recycled containers are used instead, it is ensured that bacterial contamination in the dispenser is minimized. Furthermore, it is advantageously obtained that the dispenser can be refilled quickly and easily without risk of spilled soap running down the sides of the dispenser, which then would have to be cleaned after each filling.

The third swing position of the cover can vary between the second position of the cover and a bottom position in which the cover abuts on the housing of the dispenser. Within these limits, the user can dose a dose of soap of a desired quantity and this quantity is the largest when the cover is pressed into the bottom position.

Furthermore, the invention is described above and shown in the drawing on the assumption that it is the soap container itself that functions as soap pump and that it is made of a plastic having a memory for this purpose.

Within the scope of the invention, any other expedient kind of dispenser soap pump can however be used instead just as the soap container can be of a flexible plastic without memory or in other words, be of the kind that collapses as it is emptied of soap.

What is claimed is:

1. A dispenser for a liquid or viscous soap which comprises:

a disposable soap container having a discharge end for discharging a dose of soap and a feed pump for pumping the dose of soap out of the discharge end, a housing for receiving the soap container via a front aperture, and a cover for closing the front aperture of the housing, wherein the cover is pivotally mounted about a mainly horizontal swing axis extending across an upper edge of the front aperture of the housing, wherein the cover is designed to swing between a first swing position in which the front aperture is clear, a second swing position in which the front aperture is covered and the cover is in contact with the pump, and a third swing position in which the cover has activated the feed pump influenced by an external force, and wherein the soap container is arranged as a feed pump for pumping the dose of soap out of the discharge end of the soap container when the cover is guided from its second to at least its third swing position, and wherein the soap container in a mounted position has a side which is extending at least partly out of the front aperture of the housing so that an outwardly curved area is provided, with the cover being in contact with this area in its second swing position.

2. The dispenser according to claim 1, wherein at least a part of the cover extends mainly linearly in a horizontal direction.

3. The dispenser according to claim 1, wherein the soap container is made of an elastic plastic which has memory of the original shape of the container.

4. The dispenser according to claim 1, wherein a nonreturn valve is located in the discharge end of the soap container, the valve being arranged to open at both positive pressure and negative pressure in the soap container.

5. The dispenser according to claim 1, wherein the soap container has a mainly rectangular shape as seen in a horizontal cross section.

6. The dispenser according to claim 1, wherein the housing inside has a guide for retaining the soap container in place.

7. A dispenser for a liquid or viscous soap which comprises:

a disposable soap container having a discharge end for discharging a dose of soap and a feed pump for pumping the dose of soap out of the discharge end, a housing for receiving the soap container via a front aperture, and a cover for closing the front aperture of the housing, wherein the cover is pivotally mounted about a mainly horizontal swing axis extending across an upper edge of the front aperture of the housing, wherein the cover is designed to swing between a first swing position in which the front aperture is clear, a second swing position in which the front aperture is covered and the cover is in contact with the pump, and a third swing position in which the cover has activated the feed pump influenced by an external force, and wherein the soap container is arranged as a feed pump for pumping the dose of soap out of the discharge end of the soap container when the cover is guided from its second to at least its third swing position, wherein the soap container in a mounted position has a side which is extending at least partly out of the front aperture of the housing so that an outwardly curved area is provided, with the cover being in contact with this area in its second swing position, and wherein the housing at each of two opposite sides is provided with an projecting flange extending mainly perpendicular to the swing axis of the cover, and that the cover has a breadth which is equal to or the greater than the distance between the outer edges of these flanges.

8. The dispenser according to claim 7, wherein at least a part of the cover extends mainly linearly in a horizontal direction.

9. The dispenser according to claim 7, wherein the soap container is made of an elastic plastic which has memory of the original shape of the container.

10. The dispenser according to claim 7, wherein a nonreturn valve is located in the discharge end of the soap container, the valve being arranged to open at both positive pressure and negative pressure in the soap container.

11. The dispenser according to claim 7, wherein the soap container has a mainly rectangular shape as seen in a horizontal cross section.

12. The dispenser according to claim 7, wherein the housing inside has a guide for retaining the soap container in place.

13. A dispenser for a liquid or viscous soap which comprises:

a disposable soap container having a discharge end for discharging a dose of soap and a feed pump for pumping the dose of soap out of the discharge end, a housing for receiving the soap container via a front aperture, and a cover for closing the front aperture of the housing, wherein the cover is pivotally mounted about a mainly horizontal swing axis extending across an upper edge of the front aperture of the housing, wherein the cover is designed to swing between a first swing position in which the front aperture is clear, a second swing position in which the front aperture is covered and the cover is in contact with the pump, and a third swing position in which the cover has activated the feed pump influenced by an external force, wherein the soap container is arranged as a feed pump for pumping the dose of soap out of the discharge end of the soap container when the cover is guided from its second to at least its third swing position, wherein the soap container in a mounted position has a side which is extending at least partly out of the front aperture of the housing so that an outwardly curved area is provided, with the cover being in contact with this area in its second swing position, and wherein the cover in a vertical cross section can bend in a direction opposite to that of the outwardly curved area on the front of the soap container.

14. The dispenser according to claim 13, wherein at least a part of the cover extends mainly linearly in a horizontal direction.

15. The dispenser according to claim 13, wherein the soap container is made of an elastic plastic which has memory of the original shape of the container.

16. The dispenser according to claim 13, wherein a nonreturn valve is located in the discharge end of the soap container, the valve being arranged to open at both positive pressure and negative pressure in the soap container.

17. The dispenser according to claim 13, wherein the soap container has a mainly rectangular shape as seen in a horizontal cross section.

18. The dispenser according to claim 13, wherein the housing inside has a guide for retaining the soap container in place.

19. The dispenser according to claim 13, wherein the housing at each of two opposite sides is provided with an projecting flange extending mainly perpendicular to the swing axis of the cover, and that the cover has a breadth which is equal to or the greater than the distance between the outer edges of these flanges.

* * * * *